US008141676B2

(12) United States Patent
Shen

(10) Patent No.: US 8,141,676 B2
(45) Date of Patent: Mar. 27, 2012

(54) COMPOUND MEMBRANE AND ACOUSTIC DEVICE USING SAME

(75) Inventor: Tao Shen, Shenzhen (CN)

(73) Assignees: AAC Acoustic Technologies (Shenzhen) Co., Ltd., Shenzhen (CN); AAC Technologies Pet.Ltd., Singapore (SG)

( * ) Notice: Subject to any disclaimer, the term of this patent is extended or adjusted under 35 U.S.C. 154(b) by 0 days.

(21) Appl. No.: 12/978,566

(22) Filed: Dec. 26, 2010

(65) Prior Publication Data

US 2011/0272208 A1 Nov. 10, 2011

(30) Foreign Application Priority Data

May 4, 2010 (CN) ..... 2010 1 0167971

(51) Int. Cl.
*G10K 13/00* (2006.01)

(52) U.S. Cl. ..... 181/170; 181/173; 181/167

(58) Field of Classification Search ..... 181/167, 181/170, 173
See application file for complete search history.

(56) References Cited

U.S. PATENT DOCUMENTS

| | | | | |
|---|---|---|---|---|
| 6,097,829 | A * | 8/2000 | Guenther et al. | 381/425 |
| 7,344,001 | B2 * | 3/2008 | Inoue et al. | 181/169 |
| 7,644,801 | B2 * | 1/2010 | Klein et al. | 181/157 |
| 2004/0112672 | A1 * | 6/2004 | Ono et al. | 181/169 |
| 2005/0051380 | A1 * | 3/2005 | Takayama et al. | 181/170 |
| 2007/0274545 | A1 * | 11/2007 | Nakaya et al. | 381/191 |
| 2010/0040246 | A1 * | 2/2010 | Windischberger et al. | 381/150 |

* cited by examiner

*Primary Examiner* — Forrest M Phillips
(74) *Attorney, Agent, or Firm* — Anova Law Group, PLLC

(57) ABSTRACT

The present invention provides a compound membrane and an acoustic device including such a compound membrane. The compound membrane includes a central layer, a first glue layer attached to one side of the central layer, a second glue layer attached to another side of the central layer, an upper layer provided on the first glue layer, and a lower layer provided beneath the second glue layer. The anti-fatigue performance of the compound membrane is desirable.

3 Claims, 1 Drawing Sheet

COMPOUND MEMBRANE AND ACOUSTIC DEVICE USING SAME

FIELD OF THE INVENTION

The invention relates to a compound membrane and to an acoustic device comprising such a compound membrane.

DESCRIPTION OF RELATED ART

Nowadays, speakers and/or microphones often comprise compound membranes which are basically a combination of layers of different materials or just a mixture of different materials.

A compound membrane related to the present invention includes a glue layer and a pair of additional layer attached to the two sides of the glue layer. The additional layer is made of Polyarylate. However, the anti-fatigue performance of the compound membrane is undesirable and the compound membrane suffers from a non-sufficient lifetime.

The present invention is provided to solve the problems mentioned above.

DETAILED DESCRIPTION OF THE EXEMPLARY EMBODIMENT

Reference will now be made to describe the exemplary embodiment of the present invention in detail.

Figure 1:
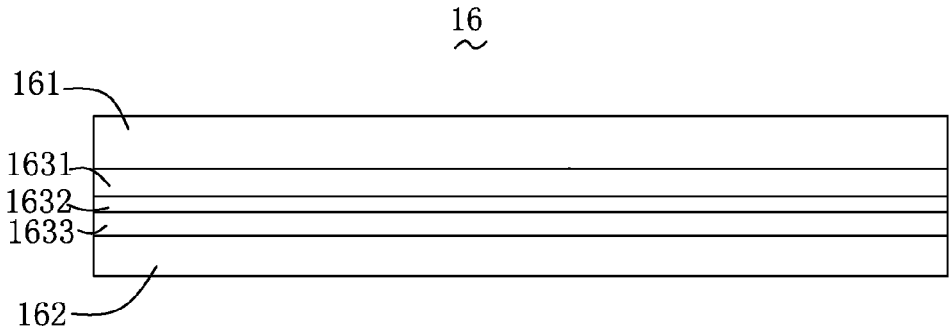
FIG. 1 is an illustrative view of a compound membrane according to an exemplary embodiment of the present invention.

Referring to FIG. 1, a compound membrane 16 comprises a central layer 1632, a first glue layer 1631 attached to one side of the central layer 1632, a second glue layer 1633 attached to another side of the central layer 1632, an upper layer 161 provided on the first glue layer 1631, and a lower layer 162 provided beneath the second glue layer 1633.

The center layer 1632 comprises material of Polyethylene Terepthalate (PET). The material of the upper layer 161 or the lower layer 162 is selected from Polyetherimide (PEI), Polyethylene Naphthalate (PEN), Polyetheretherketone (PEEK), and Polyphnylens sulfide (PPS). The glue layers 1631, 1633 comprise material of acrylic.

Figure 2:
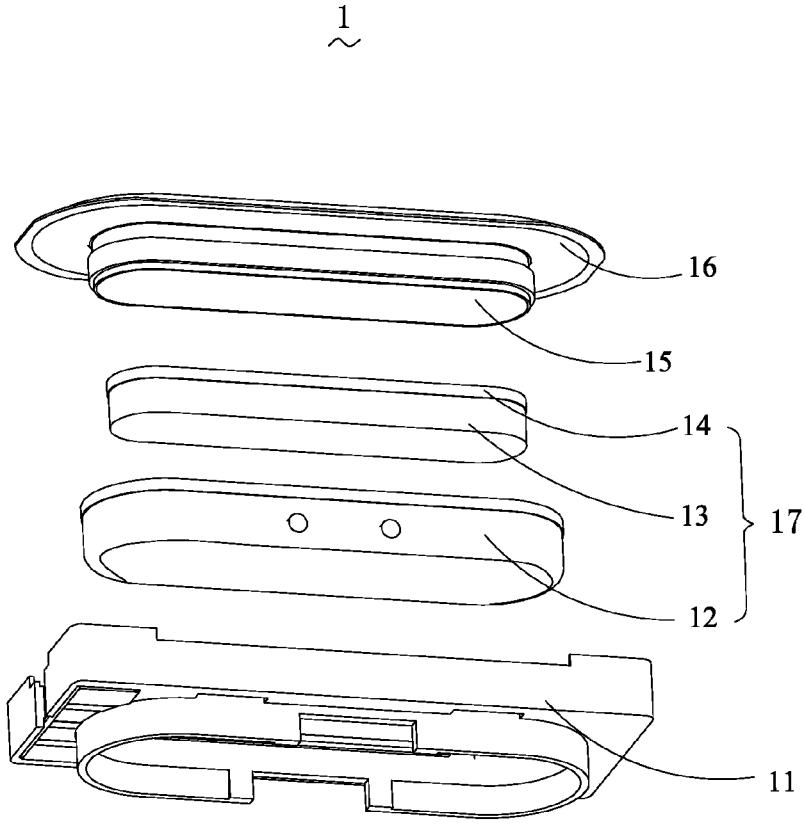
FIG. 2 is an exploded view of an acoustic device using the membrane in FIG. 1.

FIG. 2 shows an acoustic device 1 comprising such a compound membrane 16 according to the exemplary embodiment of the present invention. The acoustic device 1 comprises a compound membrane 16.

Furthermore, the acoustic device in FIG. 2 includes a housing or base member 11 and a magnetic circuit 17. The magnetic circuit 17 cooperates with a coil 15 to drive the diaphragm to move. When the coil 15 is activated by an electric audio signal, an electromagnetic force occurs between the coil 15 and the magnetic circuit 17. This forces the compound membrane 16 to be excited in accordance with the exciting acoustic signals, thereby generating acoustic waves which are emitted to an environment perceivable by a human listener. The magnetic circuit 17 comprising a yoke 12, a magnet 13 received in the yoke 12 and a plate pole 14 mounted on the magnet 13.

By virtue of the multi-layer structure, the anti-fatigue performance of the compound membrane is desirable and the compound membrane has a reasonably large lifetime.

While the present invention has been described with reference to the specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An acoustic compound membrane comprising:

A central layer;

A first glue layer attached to one side of the central layer;

A second glue layer attached to another side of the central layer;

An upper layer provided on the first glue layer; and

A lower layer provided beneath the second glue layer;

Wherein the center layer comprises material of Polyethyleneterepthalatel; and

Wherein the material of the upper layer or the lower layer is selected from Polyetherimide, Polyetherketone, and Polyphnylens sulfide.

2. The compound membrane as described in claim 1, wherein the glue layers comprises material of acrylic.

3. An acoustic device comprising:

a compound membrane as described in one of claims 1 to 2.

* * * * *